US008217873B2

(12) United States Patent
Lan et al.

(10) Patent No.: US 8,217,873 B2
(45) Date of Patent: Jul. 10, 2012

(54) LIQUID CRYSTAL DISPLAY DEVICE FOR IMPROVING COLOR WASHOUT EFFECT

(75) Inventors: Tung-Hsin Lan, Taipei (TW); Mu-Shan Liao, Taoyuan County (TW); Hung-Chun Li, Taoyuan County (TW); Ming-Chang Lin, Tainan County (TW)

(73) Assignee: Chunghwa Picture Tubes, Ltd., Bade, Taoyan (TW)

( * ) Notice: Subject to any disclaimer, the term of this patent is extended or adjusted under 35 U.S.C. 154(b) by 497 days.

(21) Appl. No.: 12/396,485

(22) Filed: Mar. 3, 2009

(65) Prior Publication Data

US 2010/0164849 A1 Jul. 1, 2010

(30) Foreign Application Priority Data

Dec. 26, 2008 (TW) ..... 97150991 A

(51) Int. Cl.
*G09G 3/36* (2006.01)

(52) U.S. Cl. ..... 345/88; 345/87

(58) Field of Classification Search ..... 345/88
See application file for complete search history.

(56) References Cited

U.S. PATENT DOCUMENTS

2007/0046567 A1* 3/2007 Ha ..... 345/38
2008/0007506 A1* 1/2008 Chen et al. ..... 345/92

* cited by examiner

*Primary Examiner* — Quan-Zhen Wang
*Assistant Examiner* — David Lee
(74) *Attorney, Agent, or Firm* — Winston Hsu; Scott Margo

(57) ABSTRACT

A liquid crystal display device for improving color washout problem is disclosed in the present invention, in which storage capacitors of two sub-pixels of a pixel are electrically connected to a next scan line and a next scan line of the next scan line, respectively, in order for utilizing driving signals of the two scan lines to modulate voltages of the storage capacitors, so as to make the two sub-pixels have different driving voltages.

9 Claims, 4 Drawing Sheets

LIQUID CRYSTAL DISPLAY DEVICE FOR IMPROVING COLOR WASHOUT EFFECT

BACKGROUND OF THE INVENTION

1. Field of the Invention

The present invention relates to a liquid crystal (LCD) display device for improving color washout effect, and more particularly, to an LCD device for improving color washout effect, caused by a side viewing angle, by modulating sub-pixel voltages through driving signals of scan lines.

2. Description of the Prior Art

Liquid Crystal Display (LCD) devices have many advantages, such as compact size, low power consumption, and low radiation. Therefore, the LCD devices have been widely applied to a mass of digital products, such as a laptop, a desktop and a personal digital assistance (PDA), and gradually replaced conventional Cathode Ray Tube (CRT) televisions to become the mainstream of consumer TV applications.

Compared with the conventional CRT device, the LCD devices tend to have brightness variation and contrast variation due to all kinds of viewing angle, and even have gray level inversion when the viewing angle is wide. Thus, a bunch of technologies, such as Multi-domain Vertical Alignment (MVA), In-Plane Switching (IPS), and etc, have been developed in industry to improve the LCD viewing angle problems. However, there still exists color washout effect and Gamma curve offset in the MVA LCD devices when people watch the screen from a large viewing angle.

One of driving approaches in the prior art, for solving the color washout effect, is dividing each pixels of the LCD into two sub-pixels. Each of sub-pixels is individually controlled by a Thin Film Transistor (TFT). Thus, by inputting two driving voltages with a subtle difference to two sub-pixels, liquid crystals of the two sub-pixels would have different inclined angles, and thereby improve the washout effect caused by a large viewing angle.

Further, as disclosed in US patent publication No. US20040001167A1, entitled "Liquid Crystal Display Device", an LCD device connects a storage capacitor of each sub-pixel to an external signal. After the TFT of each sub-pixel turns off, voltages on a counter electrode of the storage capacitors are disturbed by the external signals to diverge driving voltages of two sub-pixels, so as to improve the washout effect.

However, the aforementioned doings need not only an extra circuit for generating modulation signals of the storage capacitors, but extra layouts on the LCD panel for transmitting modulation signals of the storage capacitors. As a result, the aperture ratio of the LCD is decreased.

SUMMARY OF THE INVENTION

It is therefore an objective to provide a liquid crystal display (LCD) device for improving color washout effect.

The present invention discloses an LCD device for improving color washout effect. The LCD device includes a first data line, a first scan line, a second scan line, a third scan line, a pixel and a gate driving circuit. The second scan line is a next scan line of the first scan line. The third scan line is a next scan line of the second scan line. The pixel is formed at an intersection of the first data line and the first scan line and includes a first sub-pixel, and a second sub-pixel. The first sub-pixel includes a first liquid crystal capacitor, a first storage capacitor, and a first switch. The first liquid crystal capacitor has a first terminal and a second terminal electrically connected to a common voltage. The first storage capacitor has a first terminal and a second terminal electrically connected to the second scan line. The first switch has a first terminal electrically connected to the first scan line, a second terminal electrically connected to the first terminal of the first liquid crystal capacitor and the first terminal of the first storage capacitor, and a control terminal electrically connected to the first scan line. The second sub-pixel includes a second liquid crystal capacitor, a second storage capacitor, and a second switch. The second liquid crystal capacitor has a first terminal and a second terminal electrically connected to the common voltage. The second storage capacitor has a first terminal and a second terminal electrically connected to the third scan line. The second switch has a first terminal electrically connected to the first data line, a second terminal electrically connected to the first terminal of the second liquid crystal capacitor and the first terminal of the second storage capacitor, and a control terminal electrically connected to the first scan line. The gate driving circuit is electrically connected to the first scan line, the second scan line and the third scan line, and used for generating driving signals of the first scan line, the second scan line and the third scan line in sequence. The driving signals of two adjacent scan lines among the said scan lines have a first waveform and a second waveform, respectively. The first waveform switches among a first turn-off level, a turn-on level and a second turn-off level in sequence. The second waveform switches among the second turn-off level, the turn-off level and the first turn-off level in sequence.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
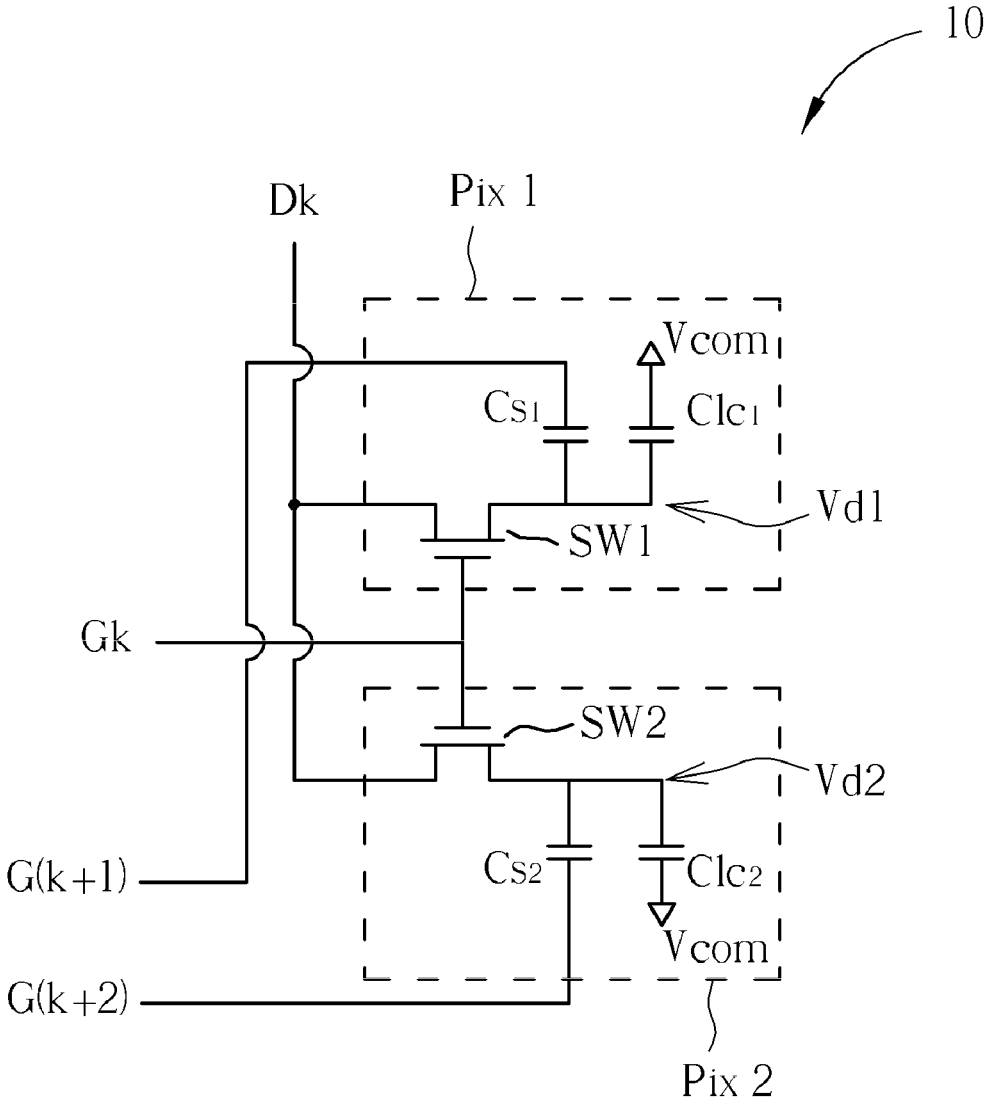
FIG. 1 is a schematic diagram of a pixel of a liquid crystal display (LCD) device according to an embodiment of the present invention.

Please refer to FIG. 1, which is a schematic diagram of a pixel 10 of a liquid crystal display (LCD) device according to an embodiment of the present invention. To improve color washout effect, the pixel 10 is composed of sub-pixels Pix1 and Pix2. Each of sub-pixels Pix1 and Pix2 include liquid crystal capacitors Clc1 and Clc2, storage capacitors Cs1 and Cs2, switches SW1 and SW2, respectively. The switches SW1 and SW2 are Thin Film Transistors (TFTs). The source electrode of the switch SW1 is electrically connected to a data line Dk. The drain electrode of the switch SW1 is electrically connected to one terminal of the liquid crystal capacitor Clc1 and one terminal of the storage capacitor Cs1. The gate electrode of the switch SW1 is electrically connected to a scan line Gk. The source electrode of the switch SW2 is electrically connected to the data line Dk. The drain electrode of the switch SW2 is electrically connected to one terminal of the liquid crystal capacitor Clc2 and one terminal of the storage capacitor Cs2. The gate electrode of the switch SW2 is electrically connected to the scan line Gk. Besides, the other terminal of the storage capacitor Cs1 is electrically connected to a scan line G(k+1). The other terminal of the storage capacitor Cs1 is electrically connected to a scan line G(k+2). The other terminals of the liquid crystal capacitors Clc1 and Clc2 are electrically connected to a common voltage Vcom. The scan lines G(k+1) and G(k+2) are a next scan line of the scan line Gk and a next two scan line of the scan line Gk, respectively.

Therefore, by driving signals of the scan lines G(k+1) and G(k+2), voltages of the storage capacitors Cs1 and Cs2 can be modulated to make driving voltages of the sub-pixels Pix1 and Pix2 different, and thereby the color washout effect can be improved.

Figure 2:
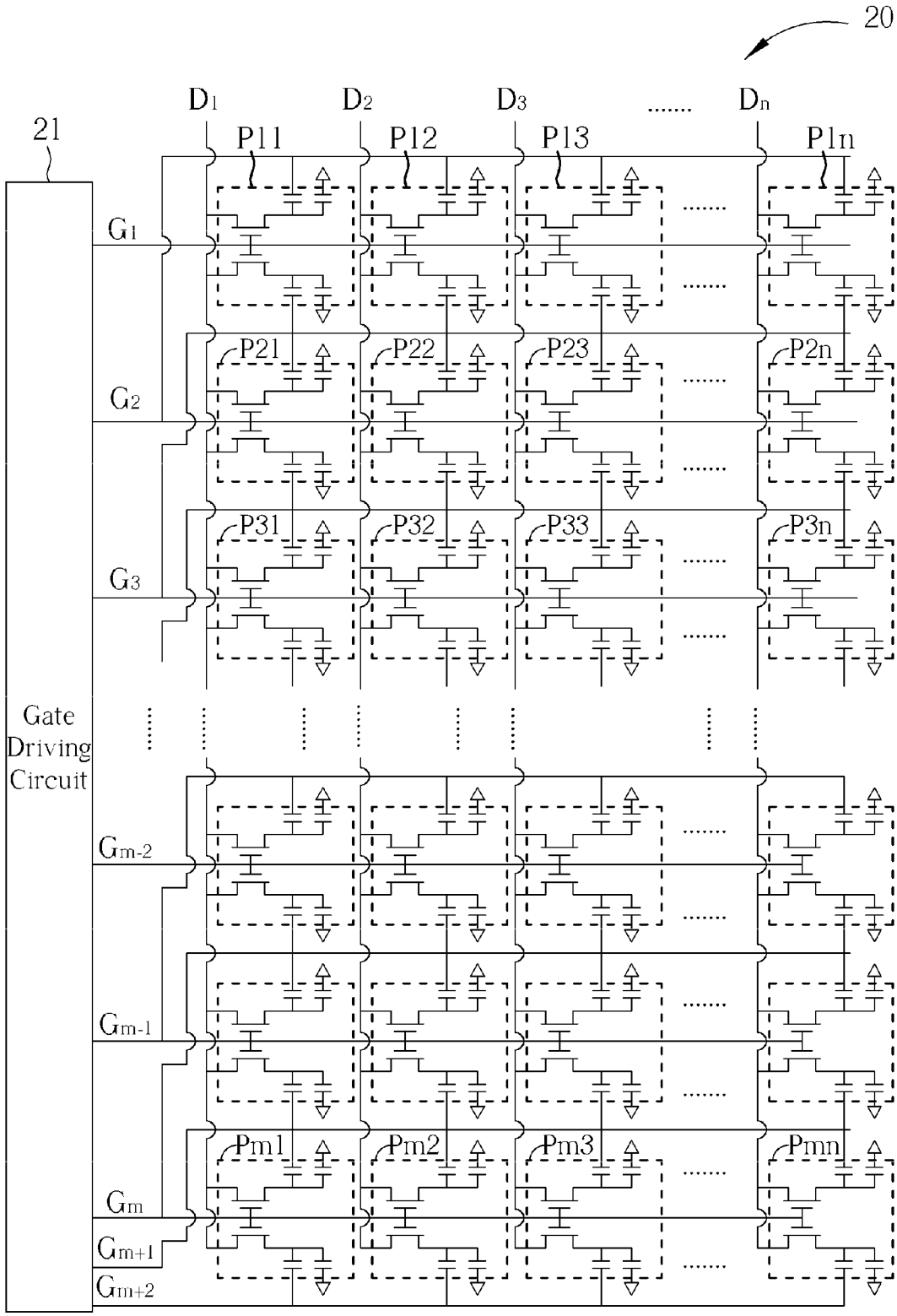
FIG. 2 is a circuit diagram of an LCD device according to an embodiment of the present invention.

Please continue referring to FIG. 2, which is a circuit diagram of an LCD device 20 according to an embodiment of the present invention. As shown in FIG. 2, the LCD device 20 includes pixels P11~Pmn, data lines D1~Dn, scan lines G1~G(m+2) and a gate driving circuit 21. The pixels P11~Pmn are implemented by the pixel 10 shown in FIG. 1, and formed at the intersection of each data line and each scan line. Each pixel is connected in the way as mentioned above, and thus not narrated herein. The gate driving circuit 21 is electrically connected to the scan lines G1~G(m+2), and used for generating driving signals of the scan lines G1~G(m+2) in sequence in order to drive the transistor switches on the scan lines G1~G(m+2). Thus, if the resolution of the LCD device 20 is n by m, the present invention only needs to add the two scan lines G(m+1) and G(m+2) on the LCD panel, such that the voltages of the storage capacitors can be modulated by the driving signals of the scan lines to make the driving voltages of the two sub-pixels different, and that the color washout effect can be improved.

Consequently, the present invention needs neither an extra circuit for generating modulation signals of the storage capacitors, nor extra layouts on the panel. Therefore, the aperture ratio of the LCD device is not affected. Regarding the detail operations of the LCD device 20, please continue referring to the following statements.

According to an embodiment of the present invention, driving signals of two adjacent scan lines have a first waveform and a second waveform, respectively. The first waveform switches among a first turn-off level Vgl1, a turn-on level Vgh, and a second turn-off level Vgl2 in sequence. The second waveform switches among the second turn-off level Vgl2, the turn-on level Vgh, and the first turn-off level in sequence. Compared with driving signals of the conventional scan lines which have only two voltage levels, the driving signal of the present invention takes advantage of one voltage level for turning on the transistor but two voltage levels for turning off the transistor. Besides, the driving signals of two adjacent scan lines have different waveforms.

Figure 3:
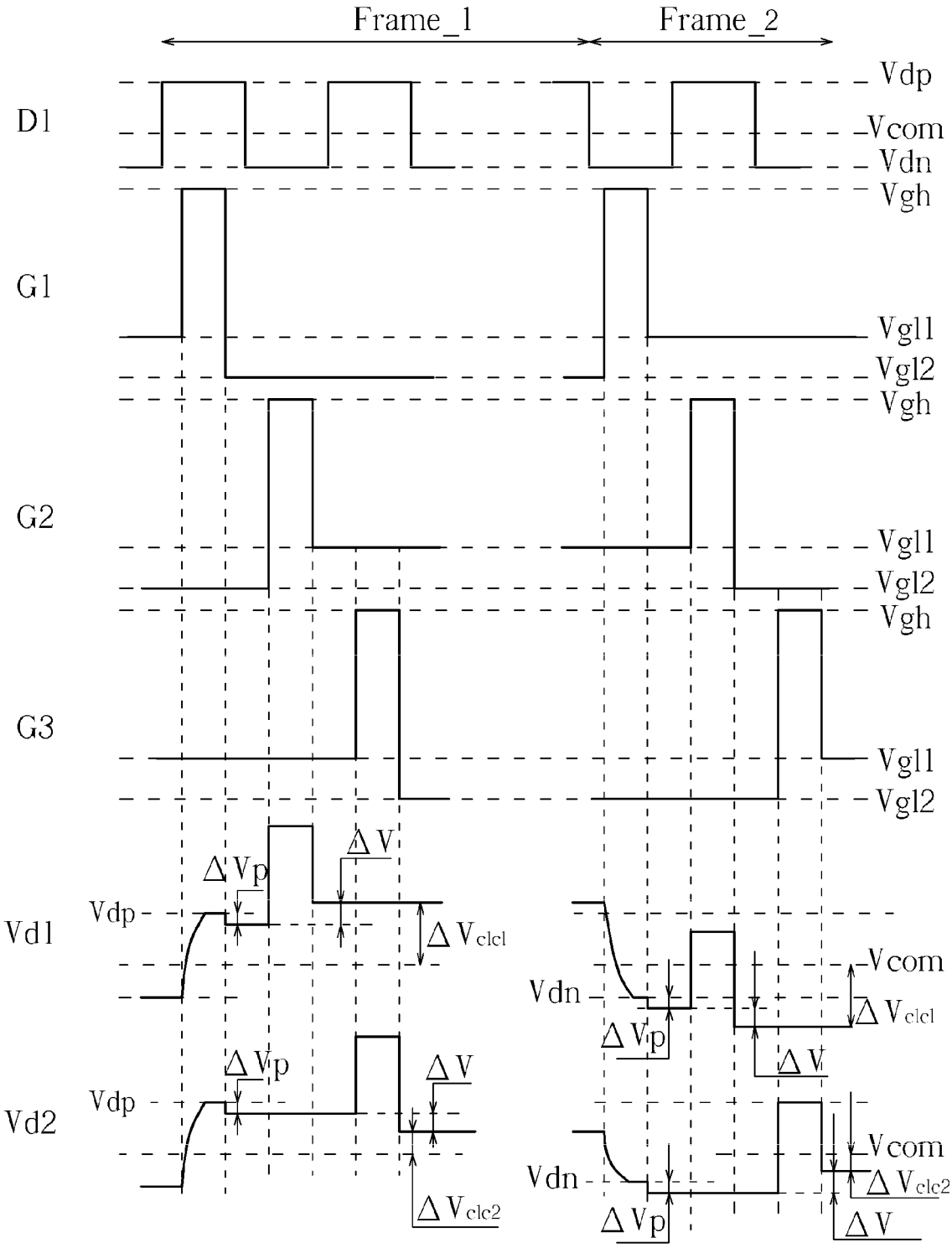
FIG. 3 is a timing diagram of the LCD device in FIG. 2.

Please refer to FIG. 3, which is a timing diagram of the LCD device 20 in FIG. 2. As shown in FIG. 3, if the driving signal of the scan line G1 has the first waveform and switches among the first turn-off level Vgl1, the turn-on level Vgh, and the second turn-off level Vgl2, the driving signals of the scan line G2 and the scan line G3 would have the second waveform and the first waveform, respectively. To take the pixel P11 as an example, when the driving signal of the scan line G1 switches from the first turn-off level Vgl1 to the turn-on level Vgh, the transistors of the two sub-pixels both turn on at the same time to allow the driving signal of the data line D1 to charge the storage capacitor and the liquid crystal capacitor, and thereby generate two identical sub-pixel driving voltages Vd1 and Vd2. When the driving signal of the scan line G1 switches from the turn-on level Vgh to the second turn-off level Vgl2, the transistors of the two sub-pixels both turn off at the same time, such that the driving voltages Vd1 and Vd2 are both kept in a floating state. In this situation, when the driving voltages of the scan lines G2 and G3 vary, for example, the driving voltage of the scan line G2 switches from the first turn-off level Vgl1 to the second turn-off level Vgl2, and the driving voltage of the scan line G3 switches from the first turn-off level Vgl1 to the second turn-off level Vgl2, the sub-pixel driving voltages Vd1 and Vd2 would have different voltage levels since the storage capacitors are disturbed.

Figure 4:
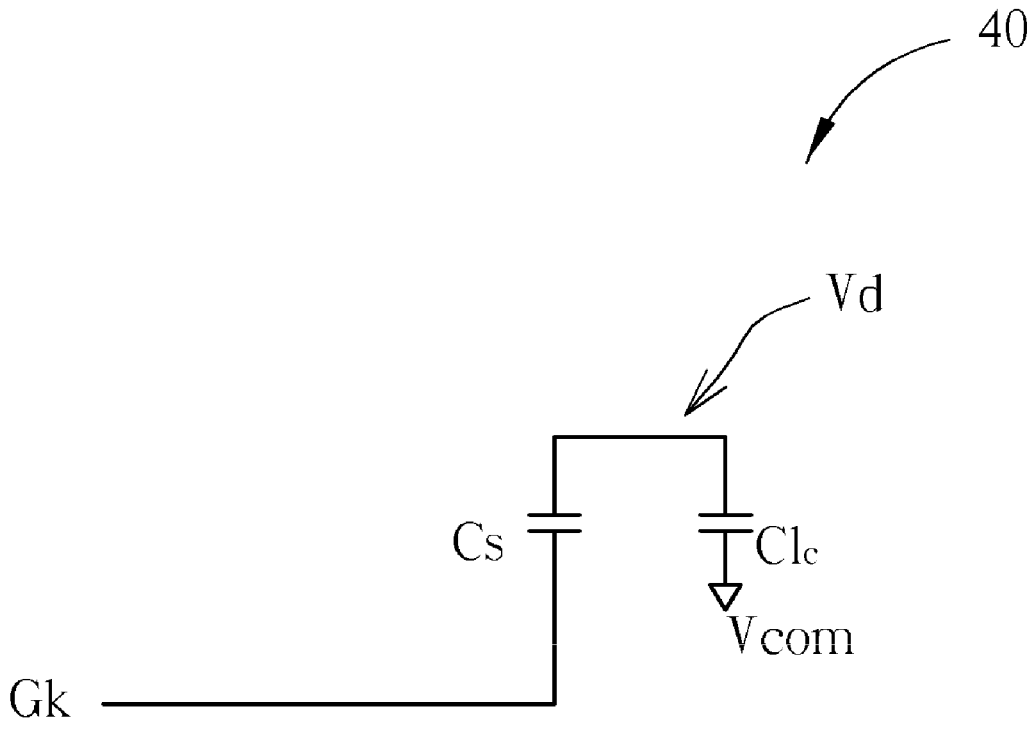
FIG. 4 is a schematic diagram of an equivalent circuit of a sub-pixel in FIG. 2 when a transistor of the sub-pixel turns off.

Please refer to FIG. 4, which is a schematic diagram of an equivalent circuit of a sub-pixel 40 in FIG. 2 when a transistor of the sub-pixel 40 turns off. According to Charge Conservation theory, when the driving signal of the scan line Gk switches from the first turn-off level Vgl1 to the second turn-off level Vgl2, a variance ΔV of the sub-pixel driving voltage Vd can be expressed by: $\Delta V=(Vgl2-Vgl1)\times(Cs/(Cs+Clc))$. Namely, the variance ΔV of the sub-pixel driving voltage Vd is a result of charge sharing performed by the storage capacitor Cs and the liquid crystal capacitor Clc on the voltage difference between the first turn-off level Vgl1 and the second turn-off level Vgl2.

Thus, please continue referring FIG. 3, when the driving signals of the scan lines G2 and G3 vary, the two sub-pixel driving voltages Vd1 and Vd2 can be expressed by:

$$Vd1=Vdp-\Delta Vp+\Delta V$$

$$Vd2=Vdp-\Delta Vp-\Delta V$$

Where, Vdp is a positive polarity voltage given by the scan line D1 when the transistor turns on; ΔVp is a voltage drop caused by coupling of a gate-drain capacitance (Cgd) when the transistor turns off. This is known by those skilled in the art, and thus not narrated herein. As a result, the sub-pixel driving voltages Vd1 and Vd2 could have different voltage levels through variation of the driving voltages of the scan lines G2 and G3.

In this situation, the gate driving circuit 21 of the present invention can further change magnitudes of the variance ΔV of the sub-pixel driving voltages by adjusting the voltage levels of the first turn-off level Vgl1 and the second turn-off level Vgl2, so as to optimize the characteristics of the LCD device according to different extents of the color washout effect. Such derivative embodiment is also included in the field of the present invention.

On the other hand, to meet the requirement of polarity inversion operation, the driving signal of each scan lines has different waveforms in two successively frames. As shown in FIG. 3, since the driving signals of the scan lines G2 and G3 have different waveforms in two successive the frame_1 and the frame_2, respectively, the sub-pixel driving voltages Vd1 and Vd2 in the frame_2 can thus be expressed by:

$$Vd1=Vdn-\Delta Vp-\Delta V$$

$$Vd2=Vdn-\Delta Vp+\Delta V$$

Where, Vdn is a negative polarity voltage given by the scan line D1 when the transistor turns on; ΔVp is a voltage drop caused by coupling of the gate-drain capacitance (Cgd) when the transistor turns off. In this situation, assuming that the positive polarity voltage Vdp is equal to the negative polarity voltage Vdn, voltages across the liquid crystal capacitors Clc1 and Clc2 are identical in two successive frames for two sub-pixels of the pixel P11, and thus no DC level variance remains.

More precisely, since the common voltage Vcom is given by: Vcom=(Vdp+Vdn)/2−ΔVp, the voltages across the liquid crystal capacitors Clc1 and Clc2 in the frame_1 can be expressed by:

$$\Delta Vclc1=Vd1-Vcom=Vdp/2-Vdn/2+\Delta V,$$

ΔVclc2=Vd2−Vcom=Vdp/2−Vdn/2−ΔV, respectively. Similarly, the voltages across the liquid crystal capacitors Clc1 and Clc2 in the frame_2 can be expressed by:

$$\Delta Vclc1=Vd1-Vcom=|Vdp/2-Vdn/2+\Delta V|,$$

$$\Delta Vclc2=Vd2-Vcom=|Vdp/2-Vdn/2-\Delta V|, \text{ respectively.}$$

Therefore, the voltages across the liquid crystal capacitors Clc1 and Clc2 are identical in two successive frames, and thus no DC level variance exists, as shown in FIG. 3.

Conclusively, the LCD device of the present invention couples the storage capacitors of the two sub-pixels to the next scan line and the next two scan line, respectively, and thus the driving voltages of the two sub-pixels can be modulated by the driving signals of the scan lines, so as a to improve the color washout effect caused by the side viewing angle. Consequently, the present invention needs neither the extra circuit for generating the modulation signals of the storage capacitor, nor extra layouts on the LCD panel. Thus, there will not be any impact on the aperture ratio of the LCD device.

Those skilled in the art will readily observe that numerous modifications and alterations of the device and method may be made while retaining the teachings of the invention.

What is claimed is:

1. A liquid crystal display (LCD) device for improving color washout effect, the LCD device comprising:

a first data line;

a first scan line;

a second scan line being a next scan line of the first scan line;

a third scan line being a next scan line of the second scan line;

a pixel formed at an intersection of the first data line and the first scan line, the pixel comprising:

a first sub-pixel comprising:

a first liquid crystal capacitor having a first terminal and a second terminal electrically connected to a common voltage;

a first storage capacitor having a first terminal and a second terminal electrically connected to the second scan line; and a first switch having a first terminal electrically connected to the first data line, a second terminal electrically connected to the first terminal of the first liquid crystal capacitor and the first terminal of the first storage capacitor, and a control terminal electrically connected to the first scan line; and a second sub-pixel comprising:

a second liquid crystal capacitor having a first terminal and a second terminal electrically connected to the common voltage;

a second storage capacitor having a first terminal and a second terminal directly electrically connected to the third scan line; and a second switch having a first terminal electrically connected to the first data line, a second terminal electrically connected to the first terminal of the second liquid crystal capacitor and the first terminal of the second storage capacitor, and a control terminal electrically connected to the first scan line; and a gate driving circuit, electrically connected to the first scan line, the second scan line and the third scan line, for generating driving signals of the first scan line, the second scan line and the third scan line in sequence;

wherein the driving signals of two adjacent scan lines among the said scan lines have a first waveform and a second waveform, respectively, the first waveform switches among a first turn-off level, a turn-on level and a second turn-off level in sequence, and the second waveform switches among the second turn-off level, the turn-on level and the first turn-off level in sequence.

2. The LCD device of claim 1, wherein the first switch and the second switch are conducted for allowing signals of the first data line being transmitted to the first sub-pixel and the second sub-pixel to generate a driving voltage of the first sub-pixel and a driving voltage of the second sub-pixel when the driving signal of the first scan line switches to the turn-on level.

3. The LCD device of claim 2, wherein the first switch and the second switch are turned off when the driving signal of the first scan line switches to the first turn-off level or the second turn-off level, and the driving voltage of the first sub-pixel and the driving voltage of the second sub-pixel are modulated by the driving signal of the second scan line and the driving signal of the third scan line, respectively, after the first switch and the second switch are turned off.

4. The LCD device of claim 3, wherein a voltage variance in the driving voltage of the first sub-pixel is a result of charge sharing performed by the first storage capacitor and the first liquid crystal capacitor on a voltage difference between the first turn-off level and the second turn-off level.

5. The LCD device of claim 3, wherein a voltage variance in the driving voltage of the second sub-pixel is a result of charge sharing performed by the second storage capacitor and the second liquid crystal capacitor on a voltage difference between the first turn-off level and the second turn-off level.

6. The LCD device of claim 3, wherein the driving voltage of the first sub-pixel and the driving voltage of the second sub-pixel have voltage variances with equal magnitudes but opposite directions.

7. The LCD device of claim 1, wherein driving voltages of the first sub-pixel and the second sub-pixel have reverse polarity in two successive frames.

8. The LCD device of claim 7, wherein the driving signal of each of the said scan lines has different waveforms in two successive frames.

9. The LCD device of claim 1, wherein the first switch and the second switch are Thin Film Transistors (TFTs).

* * * * *

UNITED STATES PATENT AND TRADEMARK OFFICE

CERTIFICATE OF CORRECTION

PATENT NO. : 8,217,873 B2
APPLICATION NO. : 12/396485
DATED : July 10, 2012
INVENTOR(S) : Tung-Hsin Lan et al.

It is certified that error appears in the above-identified patent and that said Letters Patent is hereby corrected as shown below:

On the title page, item (73), correct the residence of the assignee from "Bade, Taoyan (TW)" to --Bade, Taoyuan (TW)--.

Signed and Sealed this
Eleventh Day of September, 2012

David J. Kappos

David J. Kappos
*Director of the United States Patent and Trademark Office*